US008357847B2

(12) United States Patent
Huet et al.

(10) Patent No.: US 8,357,847 B2
(45) Date of Patent: Jan. 22, 2013

(54) METHOD AND DEVICE FOR THE AUTOMATIC OR SEMI-AUTOMATIC COMPOSITION OF MULTIMEDIA SEQUENCE

(75) Inventors: Sylvain Huet, Paris (FR); Jean-Philippe Ulrich, Paris (FR); Gilles Babinet, Paris (FR)

(73) Assignee: MXP4, Paris (FR)

( * ) Notice: Subject to any disclaimer, the term of this patent is extended or adjusted under 35 U.S.C. 154(b) by 749 days.

(21) Appl. No.: 12/373,682

(22) PCT Filed: Jul. 12, 2007

(86) PCT No.: PCT/IB2007/003205

§ 371 (c)(1),
(2), (4) Date: Nov. 4, 2009

(87) PCT Pub. No.: WO2008/020321

PCT Pub. Date: Feb. 21, 2008

(65) Prior Publication Data

US 2010/0050854 A1 Mar. 4, 2010

(30) Foreign Application Priority Data

Jul. 13, 2006 (FR) ..... 06 06428
Jan. 29, 2007 (FR) ..... 07 00586
Apr. 4, 2007 (FR) ..... 07 02475

(51) Int. Cl.
*G10H 1/00* (2006.01)

(52) U.S. Cl. ..... 84/614; 84/609; 84/649

(58) Field of Classification Search ..... 84/609, 84/614, 649

See application file for complete search history.

(56) References Cited

U.S. PATENT DOCUMENTS 5,521,323 A * 5/1996 Paulson et al. ..... 84/610
5,633,985 A 5/1997 Severson et al.
5,877,445 A 3/1999 Hufford et al.
6,194,647 B1 * 2/2001 Tateno ..... 84/609
6,867,358 B1 * 3/2005 Mester, Jr. ..... 84/609
7,015,389 B2 * 3/2006 Georges et al. ..... 84/609
7,071,402 B2 * 7/2006 Georges ..... 84/609
7,076,035 B2 * 7/2006 Loudermilk ..... 379/101.01
7,076,494 B1 * 7/2006 Baer et al. ..... 1/1
7,102,069 B2 * 9/2006 Georges ..... 84/609

(Continued)

FOREIGN PATENT DOCUMENTS

EP 1274069 A 1/2003

OTHER PUBLICATIONS

Jehan,"Creating Music by Listening," Thesis, 2005, pp. 1-157.

(Continued)

*Primary Examiner* — David S. Warren
(74) *Attorney, Agent, or Firm* — Browdy and Neimark, P.L.L.C.

(57) ABSTRACT

The method according to the invention includes the creation of a reference multimedia sequence structure, the breaking down of this structure into basic components (tracks $P_1$, $P_2$, $P_n$) each containing a series of basic subcomponents (bricks $B^1{}_1$-$B^n{}_4$), the association to each one of these basic subcomponents of a plurality of homologous subcomponents (homologous bricks $B^1{}_1\ H_i$, $B^2{}_1\ H_j$, $B^n{}_1\ H_k$) to each of which are assigned attributes and an automatic composition phase of a new multimedia sequence containing the maintaining of the subcomponents or their replacing with homologous subcomponents chosen algorithmically according to an algorithm determining the probability of the subcomponents of being chosen, considering its attributes, then by performing a random choice in respect of these probabilities.

25 Claims, 3 Drawing Sheets

U.S. PATENT DOCUMENTS

| | | | | |
|---|---|---|---|---|
| 7,491,878 | B2 * | 2/2009 | Orr | 84/609 |
| 7,613,993 | B1 * | 11/2009 | Baer et al. | 715/205 |
| 7,655,855 | B2 * | 2/2010 | Georges et al. | 84/609 |
| 7,702,014 | B1 * | 4/2010 | Kellock et al. | 375/240.08 |
| 7,754,959 | B2 * | 7/2010 | Herberger et al. | 84/626 |
| 7,812,240 | B2 * | 10/2010 | Streich et al. | 84/609 |
| 7,847,178 | B2 * | 12/2010 | Georges | 84/645 |
| 7,863,511 | B2 * | 1/2011 | McNally | 84/610 |
| 8,006,186 | B2 * | 8/2011 | Kellock et al. | 715/728 |
| 8,026,436 | B2 * | 9/2011 | Hufford | 84/609 |
| 8,082,279 | B2 * | 12/2011 | Weare | 707/804 |
| 8,153,878 | B2 * | 4/2012 | Chevreau et al. | 84/609 |
| 8,247,676 | B2 * | 8/2012 | Georges et al. | 84/609 |
| 2003/0037664 | A1 | 2/2003 | Comair et al. | |
| 2003/0084779 | A1 | 5/2003 | Wieder | |
| 2003/0188625 | A1 | 10/2003 | Tucmandl | |
| 2003/0212466 | A1 | 11/2003 | Alferness | |
| 2010/0050854 | A1 * | 3/2010 | Huet et al. | 84/611 |

OTHER PUBLICATIONS

Lazier, et. al.,"Mosievius: Feature Driven Interactive Audio Mosaicing," Proceedings of Cost G-6 Conference on Digital Audio Effects, 2003, pp. dafx-1.

* cited by examiner

METHOD AND DEVICE FOR THE AUTOMATIC OR SEMI-AUTOMATIC COMPOSITION OF MULTIMEDIA SEQUENCE

BACKGROUND

1. Field

This invention relates to a method and a device for the automatic or semi-automatic composition, in real time, of a multimedia sequence (more preferable predominantly audio) using a reference multimedia sequence structure that already exists or that is composed for the circumstance.

2. Description of the Prior Art

Generally, it is known that many solutions for producing multimedia sequences using pre-existing multimedia materials have already been proposed.

By way of example, EP 0 857 343 B1 discloses an electronic music generator including: an introduction device, one or more recording media connected to a computer, a rhythm generator, a pitch execution programme, and a sound generator. When it is manipulated by a user who wants to create and play a piece alone, the introduction device produces incoming rhythm and pitch signals. The recording media have various accompaniment tracks on which the user can, by superposing them, create and play the solo, and various rhythm blocks of which each defines for at least one note at least one instant when the note must be played. The recording medium records at least one portion of the solo created by the user during a lapse of time of a given duration, which has just elapsed. The rhythm generator receives the rhythm signals introduced by the introduction device, selects one of the rhythm blocks in the recording medium according to said signals and gives the command to play the note at the instant defined by the selected rhythm block. The pitch execution programme receives the pitch signals introduced by the introduction device and selects: the appropriate pitch according to said signals, the accompaniment track chosen by the user, and the recorded solo. The pitch execution programme then produces the appropriate pitch. The sound generator having received the instructions from the rhythm generator, the pitches from the pitch execution programme, as well as the indication of the accompaniment track chosen by the user, produces an audio signal function of the solo created by the user and from the chosen accompaniment track.

Moreover, EP 1 326 228 discloses a method making it possible to interactively modify a musical composition in order to obtain a music to the tastes of a particular user. This method in particular uses the intervention of a song data structure wherein musical rules are applied to musical data that can be modified by the user.

In fact, the previously-described solutions consist primarily in a denaturation of a departing musical sequence, according to a continuous process linked to a hard-coded digital music file format.

OBJECTS

The invention has for purpose a method making it possible to compose multimedia sequences in a musical space defined by the author and wherein the listener could navigate by possibly making use of interactive tools.

SUMMARY

To that effect, it proposes a method for the automatic or semi-automatic composition in real time of a multimedia sequence including a prior phase including the creation of a reference multimedia sequence structure and the breakdown of said structure into basic components that can be assimilated to tracks ($P_1$, $P_2$, $P_n$), each of these basic components being broken down into a set of basic subcomponents (or bricks ($B_1^1$-$B_4^n$)) which can consist of musical movements, harmonies or styles and an automatic composition phase in real time of a new multimedia sequence containing a choice of subcomponents.

According to the invention, this method is characterised in that the prior phase includes the assigning to each of the subcomponents of psychoacoustic descriptors or attributes and the storage of subcomponents and descriptors or attributes that are assigned to them in databases and in that the automatic composition phase includes the generation on the basic components of a sequence of subcomponents wherein the chaining which is characterised by a maintaining or a replacing of the subcomponents, is calculated according to an algorithm that determines, for each subcomponent a selection criterion taking into account its psychoacoustic descriptors or attributes and context parameters, said composition phase repeating through looping, each sequence regenerating itself permanently by associating a subcomponent to each basic component, the listener being able to intervene in real time on the choice of subcomponents by influencing the operation of above-mentioned algorithm.

This method thereby makes it possible to generate a multimedia sequence in real time as you go along (not once and for all at the beginning). This generation can continue indefinitely by looping (no natural end), the sequence regenerating itself permanently by associating subcomponents chosen algorithmically in the databases, the user being able to intervene at the level of the choice of subcomponents by influencing the operation of the algorithm.

The previously-described method could possible include the association, to each of these subcomponents, of a plurality of homologous subcomponents (or homologous bricks) contained in files stored in databases and to each one of which are assigned attributes. The automatic composition phase could then include the replacement of subcomponents with homologous subcomponents and the determination for each homologous subcomponent (the same as for the basic subcomponents of the probability of this subcomponent to be chosen), taking its attributes into account.

As previously mentioned, the algorithm is based on a probability calculation. It determines for each subcomponent a probability of being chosen, then performs a random choice in respect of these probabilities.

The probabilities can be calculated by applying rules that are independent of the substance of the subcomponent (for example non musical rules): the rules can for example consider that the choice of a subcomponent can influence the other concomitant choices or those to come: a rule could therefore for example consist in modifying the probability of choosing a variation according to previous choices.

It thus appears that a sequence, for example a musical one could have intervene, in accordance with the method according to the invention:

- a number N of components (or tracks),
- for each one of these basic components (or tracks) a set of subcomponents (for example musical bricks),
- a set of rules defining how the choice of a subcomponent (brick) influences subsequent choices,
- means of interactive key entry allowing the user to activate or deactivate the above-mentioned rules.

The basic components (tracks) can be in an active state or in an inactive state (pause). This state is determined by prior or concomitant subcomponent choices.

The choice carried out in accordance with the method according to the invention could possibly entail the subcomponent benefiting from the maximum probability (thereby a non-random choice).

The rules could be characterised by a degree of importance or priority. In this case, when two rules are contradictory the one of less importance is momentarily deleted in such a way that a choice of subcomponent is always possible (at least one brick with a non-zero probability).

The subcomponent (brick) choice algorithm could be generalised in order to allow for the choice of other parameters of the music: volume of a track, degree of repetition, echo coefficient, etc.

Furthermore, the subcomponent choice algorithm could be generalised to content types other than music (selection of a video sequence, texts, etc.).

Thanks to the previously-mentioned measures, the invention makes it possible to produce musical compositions of which the execution could give rise to a large degree of variability, and a possibility of unlimited adaptation using a single file composed according to the method of the invention.

Computer technology intervenes here no longer only as a means of reproduction, but as a means of interaction with a music. This does not concern automatic music, in the sense that the musical creation phase is always central and absolutely fundamental for the quality of the music generated.

However, the work of the author is substantially modified by the implementation of the invention: this involves for the author defining a music space wherein the listener will be led to navigate, possibly using interaction tools.

More precisely, the method according to the invention could include the following steps:

- the creation using a predefined musical sequence of tracks comprised of successions of musical bricks by application of a filter or processing on said musical sequence,
- the creation of a base of musical bricks including the bricks thereby created as well as pre-existing bricks selected according to their coherence with the created bricks,
- the definition of a nomenclature of psychoacoustic descriptors,
- the construction of a table defining a score for each pair (brick; descriptor),
- the definition of a subset of descriptors on which a user can interact through the intermediary of a mixing interface, via a specific interaction weight,
- the construction of a list of mixing functions, each function being linked to a track, each function being applied to a candidate brick with the context parameters (brick that has just been played, bricks currently being played on the other tracks, interaction weight defined by the user) and having for result a pertinancy ratio for the candidate brick,
- the selection of the candidate brick for which the result of the mixing function is maximal.

BRIEF DESCRIPTION

An embodiment of the invention shall be described hereinafter, by way of example that is not restrictive, with reference to the annexed drawings wherein.

DETAILED DESCRIPTION

Figure 1:
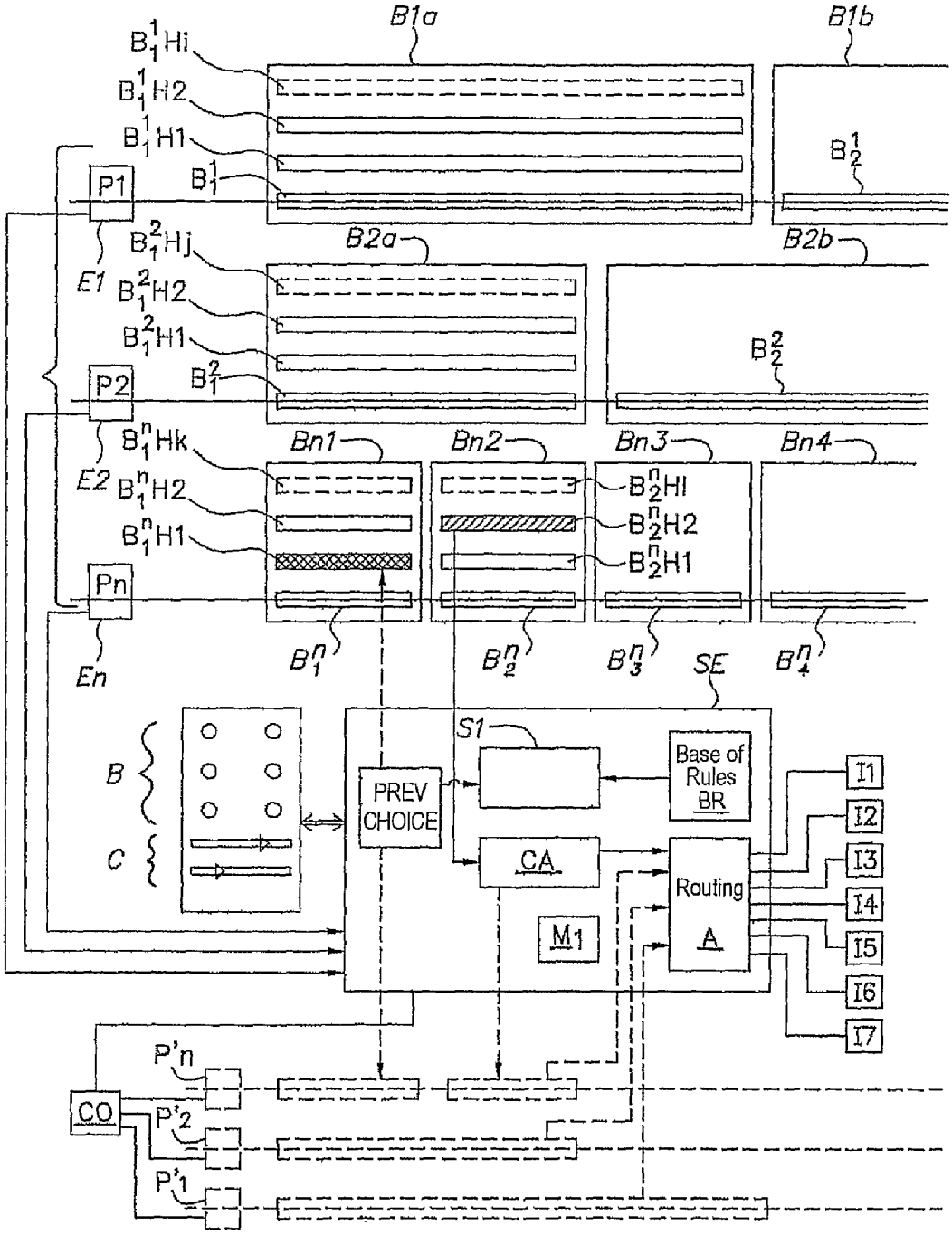
FIG. 1 is an overview diagram making it possible to show the principle used by the method according to the invention.

In the example shown in FIG. 1, the method according to the invention uses a reference multimedia sequence broken down into n tracks $P_1, P_2 \ldots P_n$.

Each track includes a succession of subcomponents or reference bricks. In this way:

- track $P_1$ includes a succession of bricks $B_1^1$, $B_2^1$, etc.
- track $P_2$ includes a succession of bricks $B_1^2$, $B_2^2$, etc.
- track $P_n$ includes a succession of bricks $B_1^n$, $B_2^n$, $B_3^n$, $B_4^n$, etc.

To each one of the reference bricks of each track is associated a series of homologous bricks. In this way, in particular:

- to brick $B_1^1$ are associated homologous bricks $B_1^1 H_1$, $B_1^1 H_2$ $B_1^1 H_i$,
- to brick $B_1^2$ are associated homologous bricks $B_1^2 H_1$, $B_1^2 H_2$ $B_1^2 H_j$,
- to brick $B_1^n$ are associated homologous bricks $B_1^n H_1$, $B_1^n H_2$ $B_1^n H_k$,
- to brick $B_n^2$ are associated homologous bricks $B_2^n H_1$, $B_2^n H_2$ $B_2^n H_l$.

Of course, the invention is not limited to a determined number of tracks, reference bricks or homologous bricks. Moreover, the data relative to the tracks, reference bricks and homologous bricks is stored in files or in databases $B_{1a}$, $B_{1b}$, $B_{2a}$, $B_{2b}$, $B_{n1}$, $B_{n2}$, $B_{n3}$, $B_{n4}$.

These files or databases are used by a computer system SE called hereinafter "expert system" designed in such a way as to provide the functions of a virtual mixing console and which consequently contain:

- a base of rules (BR),
- selection means $S_1$ of bricks (reference or homologous) in the various files $B_{1a}$, $B_{1b}$, $B_{2a}$, $B_{2b}$, $B_{n1}$, $B_{n2}$, $B_{n3}$, $B_{n4}$,
- means for detecting the state $E_1$, $E_2$, $E_n$ of the reference tracks $P_1$, $P_2$, $P_n$,
- control buttons B and/or cursors C designed to offer the user a multiplicity of possibilities for interaction,
- means of calculation CA for the composition in real time of a new multimedia sequence having the new virtual tracks $P'_1$, $P'_2$, $P'_n$ intervene, each containing selected bricks.

This new multimedia sequence can be memorised temporarily in a memory $M_1$ or be played in real time at the time of its composition.

- means of control CO of the state of the new tracks $P'_1$, $P'_2$, $P'_n$,
- a routing station A designed to transmit after any needed processing the selected bricks to the destination of appropriate multimedia interfaces $I_1$ to $I_2$ such that, for example, loudspeaker enclosures, displays, sources of light, etc.

In this example, the selection via selecting device $S_1$ of brick $B_2^n H_2$ according to the previous choice of brick $B_1^n H_1$ and its integration into track $P'_n$ is shown.

The reference multimedia sequence structure, shown by tracks $P'_1$, $P'_2$, $P'_n$, which has any duration, possibly unlimited, is called hereinafter "piece". It is obtained at the end of a step of composing the piece, a file-creating step and a step for playing the files and executing the corresponding pieces.

The step of composing a piece includes the definition of the following elements:

- the structure of a virtual mixing console of the piece with identification of tracks, for example audio/text/video, and for each of these tracks, specific attributes (for example the volume for an audio track) and with identification of the interaction controls (cursors C or buttons B) that are possibly offered to the users,
- the interactive structure of the piece, with identification of the samples of an audio track, styles, passages of the piece, and generally, of the way in which these elements interact and evolve, and of which the interaction buttons act on this structure,
- basic multimedia components "or bricks" which can for example consist of musical extracts, video extracts, 3D animations, texts, audio and video filters, being understood that each brick is a time sequence of limited duration, coding diverse multimedia events.

This interactive structure can be defined either:

- using a structure model, for example a model managing a musical style, a musical passage (for example: refrain/verse), a voice track, an "original piece" track and several accompaniment tracks,
- via direct work on the structure of the piece.

The files contains or reference previously-mentioned composition elements and, in particular, the basic multimedia components (bricks). They are designed to be used by a computer system of the system expert type in order to carry out the abovementioned composition phase of the piece.

The encoding format of the contents of each multimedia component is not hard-coded: therefore, for the audio for example, a Windows audio video file extension (registered trademark), wav (registered trademark) or the mp3 standard (registered trademark) or any format that the expert system can recognise can be used.

The expert system SE consists of a software able to read the files then to execute the corresponding pieces. It is capable of interpreting the multimedia components (bricks) contained or referenced in the file.

The expert system is capable of handling the interaction controls (buttons) possibly automatically, without having recourse to a user, but by offering the user in general an interaction interface. It furthermore makes it possible to switch from one piece to another.

The function executed by the expert system is presented as the manipulation of a virtual mixing console having the following characteristics:

- a potentially infinite number of tracks,
- tracks that can be activated and deactivated unitarily,
- tracks of a varied nature: audio, video, text, ambiance, abstract control, etc.,
- a potentially infinite number of interaction cursors,
- each activated track chains together subcomponents that are compatible with the type of track: audio bricks for an audio track, for example,
- when a subcomponent is chosen for a track, the expert system also chooses a minimum duration during which this subcomponent will be maintained.

This mixing console can be configured. So, for example, for an audio track, the information that is taken into account could include the audio component to be played, the volume, the minimum playing duration for the component. For a display, the information taken into account could include, for example, a text element to be displayed, the character font used.

Structurally, the expert system includes two distinct portions:

- an abstract engine working on constraints imposed by the base of rules and providing a selection of subcomponents of a varied nature,
- a model of the mixing console allowing the interaction interface to be generated using the selected elements.

The calculations performed by the expert system are based on the following considerations and calculation rules:

a) Notion of space, system and state

The space is comprised of systems "S"; each system is a vector of states "E". So, for example:

- a track is a system S for which states E are the musical bricks,
- a series of harmonies is a system in which the states are the harmonies.

At any time, a system S is either suspended, or in a state E. In the latter case, the state E is said to be active. It is denoted as E(S).

The systems interact via non symmetric "$\gamma$" and "$\tau$" relations.

$S'\gamma S$: means that the state of S depends on the state of S'. Cycles of the relation $\gamma$ are not allowed: $S_1\gamma S_2\gamma \ldots S_n\gamma S_1$ is impossible.

$S'\tau S$: means that the state of S depends on the "previous" state of S'. The previous state of a system S is denoted as E'(S). The $\tau$ relation can be reflexive.

The $\gamma$ or $\tau$ relations and the systems can be linked to states by an $\alpha$ relation:

$E\ \alpha\ S$: if E is inactive, then S is suspended $E\ \alpha\ \gamma$: if E is inactive, then $\gamma$ is suspended.

A suspended relation loses all influence.

When two systems S and S' are in $\gamma$ or $\tau$ relation, a probability matrix of the states of S' to the states of S is defined. The expression $a\ \gamma_p\ b$ is thus written to indicate that a state a of S' contributes with a probability p to the state b of S. This contribution is also denoted as $p_{S'\gamma S}(a,b)$, and even p(a,b) when there is no ambiguity possible. This contribution is a positive real number (possibly zero).

A suspended system may continue to influence via a $\gamma$ or $\tau$ relation: the probability matrix is extended to the "suspended" state of the source system.

Note that a system having only one state and with no $\alpha$ relation can activate only the latter. This is an "absolutely constrained system", since its state is always known.

A constraint is defined as being the manner of forcing a system to be in a certain state.

Note that a $\tau$ relation is thereby equivalent to a $\gamma$ relation with constraint; $S\ \tau S'$ is replaced with:

- a system $S_{prev}$ congruent to S (i.e. with the same states)
- a relation $S_{prev}\ \gamma S'$, of the same matrix as relation $\tau$
- the constraint $E(S_{prev})=E'(S)$.

Moreover, note that a constraint can be seen more generally as a $\gamma$ relation between an absolutely constrained system and the system to be constrained. The matrix for this relation is thereby reduced to a vector of which all of the coefficients except one are zero.

Since constraints can be contradictory, they must be ordered by assigning them an importance. For this reason, a level of importance is assigned to the $\gamma$ and $\tau$ relations, as well as to the constraints.

This level of importance may possibly be infinite for the γ relations. It must be finite for τ relations and for constraints; this is justified by the fact that:

it must be possible to be able to maintain the space in a given state, which could require locking τ relations, the constraints applied must be considered as desires.

b) Notion of resolution (or reduction)

$b_1$: Resolution and freely-calculateable space

The reduction of a system S consists in determining the probability of each of its states, then in making a random selection that takes these probabilities into account. This selection determines the state of system S.

Probability, before normalisation, of a state b of S is:

$p(b)=\Pi_{S'\gamma S}p(E(S'),b).\Pi_{S'\tau S}p(E'(S'),b)$

This probability is calculated on non-suspended γ or τ relations.

Normalised probability of a state b of S is:

$p(b)=p(b)/\Sigma_{a\in S}p(a)$

This probability exists only if the sum located in the divisor is not zero, i.e. if there exists at least one state with a non-zero probability before normalisation.

The resolution of the space consists in determining the state of all of the systems in such a way that the possible relations are satisfied.

A space is "freely calculateable" if there is a resolution by talking only into account relations of infinite importance.

The rest of this document only covers spaces that are "freely calculateable".

$b_2$: Resolution under constraint

The resolution under constraint consists in imposing the state of some systems.

The constraint always consists in posing E(S)=b.

Constraints are associated with a criterion of importance, which defines a total order (this notion of importance depends on the application that uses the mixing calculation).

The resolution under constraint consists in determining the state of all the systems, in such a way that all of the relations and all of the constraints are respected, including relations of finite importance.

$b_3$: Low resolution under constraint

Low resolution consists in identifying a solution by possibly suppressing a few constraints or relations, by applying the following rule: when the resolution under constraint fails, all of the constraints or relations that caused the failure are determined, the constraint or relation of least importance is suppressed, and the resolution is started again.

It is evident that an "freely calculateable" space can always be resolved in a low manner: in the worst of cases, it can be resolved by suppressing all of the constraints and all of the relations of finite importance.

$b_4$: Systemes and arithmetical relations

Arithmetical systems are defined, which are particular systems for which the states are real numbers. $S_a$ . . . is written. These are therefore systems for which the states are of an infinite number and in congruence with the realm of real numbers.

Arithmetical relations are defined. Instead of defining gamma and tau relations between systems $S_1, S_2, \ldots, S_n$ and a system S, these relations are represented in the form of an arithmetical expression between the systems $S_1, S_2, \ldots, S_n$ and the system S.

This expression is based on the present or past states of systems $S_1, S_2, \ldots, S_n$ and provides the active state of S.

If a system is arithmetical, its state is a real number (by convention: 0 if the system is suspended).

For example:

S:=if $(E(S_1)+E'(S_2))=0$ then a else b

S:=1+if $E(S_1)=a_1$ then 0 else 1

(where a and b are states of S, $a_1$ a state of $S_1$, and $E'(S_2)$ is the previous state of $S_2$).

The primitives are:

+, *, −, /, %, &, |, &&, ||, ∧, !, ~ if . . . then . . . else . . .

rand (returns a real number between 0 and 1)

sin, cos, tan, . . .

It is then said that system S is in arithmetical resolution. In the opposite case, system S is in quantum resolution.

It is shown that there is inclusion of the arithmetical resolution in the quantum resolution, such that the preceding considerations on the resolution of spaces remain valid.

In order to maintain the complexity of the resolution within reasonable limits, the following limitations are set:

an arithmetical system is always in arithmetical resolution, since otherwise the quantum relations matrices would have infinite sizes a constraint cannot be applied on a system that depends on an arithmetical resolution, since that would amount to calculating the inverse of any arithmetical function:

the system is not in arithmetical resolution the system does not depend, either directly or indirectly, on a system in arithmetical resolution.

This limitation could be transgressed in certain cases to reduced complexity and which would be tedious to implement as quantum resolution. For example: S=if E(S')!=E'(S') then a else b.

$b_5$: Examples of quantum resolution calculations

By convention, when probability contributions are not stated, they are considered to have the value of 1.

---

"Not" Operator

Definitions:

SγS'

S={a,b}

S'={a',b'}

P(a,a')=p(b,b')=0

Thus, considering that a≡a'≡true, and b≡b'≡false:

E(S')= !E(S)

E(S)=a⇔E(S')=b'

E(S)=b⇔E(S')=a'

"Nand" Operator

Definitions:

$S_1\gamma S'$ $S_2\gamma S'$

S'γS $S_1=\{a_1,b_1\}$ $S_2=\{a_2,b_2\}$ $S'=\{ a_1a_2, a_1b_2, b_1a_2, b_1b_2,\}$

S={a,b}

$p(a_1,b_1a_2)= p(a_1,b_1b_2)=0$ $p(b_1,a_1a_2)= p(b_1,a_1b_2)=0$ $p(a_2,a_1b_2)= p(a_2,b_1b_2)=0$ $p(b_2,a_1a_2)= p(b_2,b_1a_2)=0$ $p(a_1a_2, a)=0$ $p(a_1b_2, b)=0$ $p(b_1a_2, b)=0$ $p(b_1b_2, b)=0$

Thus, considering that $a_1$≡$a_2$≡a'≡true, and $b_1$≡$b_2$≡b'≡false:

$E(S)= !E( S_1)\wedge E( S_2)$

Oscillator

Definitions

SτS

S={a,b} p(a,a)=p(b,b)=0

So, at each new resolution, system S changes state.

Rom

-continued

Definitions
S={a}
System S is always in state a.
Disable
Definitions:
S={a}
S'={enable, disable}
SγS'
p(a,enable)=1
p(a,disable)=0
So, the enable state is always active, the disable state is never active.
Markov Chain
Definitions:
SτS
S={a,b,c}
p(a,c)=0
p(b,a)=0
p(c,a)=0
Suppose that the initial state of S is a.

Then, the system remains a certain time in state a, then switches to state b, then evolves endlessly between state b and state c, never returning to state a.

$b_6$: Low resolution algorithm under constraint

For the resolution under constraint, a set of constraints (S,b,n) is provided: system S is constrained in state b with importance n.

The algorithm is as follows:

preparation:
- constraints are associated to their system. If several constraints apply to a same system, the constraint with higher priority is conserved
- systems are initialised in the "unresolved" state
- then recursively, chose a soluble system:
- the system is not yet resolved
- the α relations of this system lead to states for which the systems are resolved
- if this system is in quantum resolution:
  - all incoming relations are in a known state (suspended or not)
  - the incoming non-suspended gamma relations have a resolved source
- if the system is in arithmetical resolution:
  - all of the systems used in the arithmetical relation are resolved
- heuristic: interest is first given to systems in arithmetic resolution, then to the system in quantum resolution having the least amount of states possible
- it is determined if the system is suspended, if so, the system is resolved by placing it in a "suspended" state and this continues recursively
- otherwise in arithmetic resolution:
- the arithmetic expression is evaluated, which gives the new state
- this is resolved recursively
- otherwise a quantum resolution:
- the probabilities of non-suspended states of the system are calculated
- if no state is possible, or if the system is constrained on an impossible state, resolution of this system fails, lacking a candidate state
- a drawing is carried out with respect to the probabilities, then the states are tried starting with the one that obtained the best score
  - a state is chosen, and resolved recursively
  - if the recursive resolution fails, proceed to the following state
  - if no state is possible, the resolution fails In case of failure, we therefore look to the last system that caused the failure (the last one that failed, lacking a candidate state). Then we move back up along the tree of alpha, gamma and tau relations which lead to this system, the list of constraints and relations of finite importance that led to this failure is determined. The constraint or relation of least important is then suppressed, and resolution is started again.

Since the space if freely calculateable, there is always a solution, by removing all of the constraints and all of the relations of finite importance in the worst of cases.

Of course, the previously-mentioned concepts and rules must be adapted to the specificity of the functions executed by the expert system.

So, initially, it is suitable first of all to define a list (possibly empty) of initial constraints, which will be applied during the first evaluation.

A certain number of systems will be defined as "masters", being understood that any system is associated to at least one master system (possibly itself).

Master systems decide the time of the next resolution for their slave systems.

Each state of a master system defines a "basic duration". When the state of a master system is activated, a new resolution must take place after the basic duration. This resolution will be partial:

- for the non-suspended systems that are not slaves of this master system, a prolongation constraint of the active state is applied with a quasi-infinite importance (higher than all of the other levels of importance of the space).

Generally, it can be considered that a "master" system is so for the entire space, which avoids partial resolution.

Moreover, it is suitable to define the "mixing console" which is a list of typical tracks.

Each track is associated to one or more systems S of the space of mixing calculation. For example, for an audio track:

- a system will indicate the musical brick to be played (the states of the system are congruent with the bricks of the track)
- an arithmetical system will indicate the number of repetitions
- an arithmetical system will indicate the importance of the repetition constraint
- an arithmetical system will indicate the volume.

For a style track:

- a system will indicate the current style
- an arithmetical system will indicate the minimum time to maintain the style
- an arithmetical system will indicate the importance of the constraint to maintain the style
- etc.

In practice, the tracks are associated to:

- a main system that selects the subcomponents that are being played
- secondary systems that define attributes of the track; when these attributes are constant it can be avoided having to define systems to represent them (it would entail in any case absolutely constrained systems, without alpha relation).

When a tracks changes state, a minimum desired duration is determined, using the attributes.

Once the mixing console is defined, the constraints to be applied to each track are defined. During the resolution performed by the expert system:

- prolongation constraint: the state must be maintained imperatively (a musical brick that is not finished)
- repetition constraint: the state should be renewed (repetition of music, maintaining of a style, etc.)

manual constraint: the user forces switching to a given state.

For each constraint, a level of importance is defined, by using constants or values of arithmetical systems.

Of course, the audio tracks that depend on a same master system will have to be synchronised. So, when an audio brick is selected on a track, playing of it begins at the exact moment of the resolution that led to its selection. This playing is not carried out in the form of a loop, even if the brick is to be repeated, so, during the next resolution:

either the brick is still being played (prolongation constraint), and playing simply continues or the playing of the brick is finished and, if the brick remains selected (after for example a repetition constraint), playing is started again at the exact moment of this new resolution.

As previously mentioned, the expert system makes use of a file designed to bring together in a structured manner the following elements:

definition of the mixing calculation definition of the multimedia elements definition of the mixing console definition of the tracks, and the link between the tracks link between the tracks and their attributes and the mixing calculation systems link between the multimedia elements and the states of the mixing calculation definition of the constraints proposed for interactivity and of the conduct to hold when interactivity is not offered by the expert system.

This file consists of an xml description file, containing four types of tags: component, system, constraint, framework, <component . . . >

<system . . . >

<constraint . . . >

<framework . . . >

These tags can have the following two attributes:

name: name used for searching or displaying id: unique id for the entire file

The attributes are either:

a constant a system id, the attribute then takes the value of the current state of the system The component tag describes a component of the mixing console having a main attribute:

Type=audio|abstract|general|, etc.

It generally has the attribute:

Select: current value of the component (generally a mixing console system id)

The "general" component makes it possible to define general attributes of the file (main tempo, main volume, etc.). Such a component does not normally include a select attribute.

When it has one of the following attributes, this means that the component will maintain the current value for a certain time.

length: duration in seconds repeatmin/repeatmax: number of repetitions level: importance of the maintaining constraint The component may also contain the "master" attribute which indicates that the evaluation of the mixing console must be carried out at the end of the "basic duration". This basic duration is determined by the basic duration of the current state of the "select" attribute.

For a component of the "audio" type, there will also be the following attributes:

Volume_left: left voice volume

Volume_right: right voice volume

The system tag describes a mixing calculation system as well as the relations that determine it.

Its attributes are, in addition to "name" and "id":

Type=select|numerical eval=quantum|arithmetical

The type has the following values:

select: a choice from a list of states numerical: a numerical value

The evaluation mode has the following values:

quantum: quantum reduction (only for the select type)

arithmetical: arithmetical expression

The subtags are:

<alpha . . . >

<state . . . >

<relation . . . >

<expr . . . >

The alpha subtag defines an alpha relation for the system.

The attribute is:

State: id of the state that triggers the alpha relation

The state subtag defines, only for a system of the "select" type, one of the possible states of the system.

The name and the state can sometimes be interpreted as a numerical value.

The attributes are, in addition to "name" and "id":

type=audio|abstract enable=on|off

When enable is equal to "off", the state cannot be selected.

For a state of the "audio" type, the attributes are also:

File: wav file

Time: time of wav file

Stereo: type of wav file

Bytestart: starting byte of the data stream in the wav file

Bytelength: size of the data stream in the wav file

Volume_left: left voice volume

Volume_right: right voice volume

Durations or coefficients for repetition are also defined:

Length: duration in seconds

Repeatmin/repeatmax: number of repetitions

Level: importance of the maintaining constraint

The relation subtag defines a gamma or tau relation for the system.

The attributes are, in addition to "name" and "id":

type=gamma|tau source: id of the source system level: level of importance

It accepts the following subtags:

<alpha . . . >: any alpha relation(s)

<matrix >: probabilities matrix (in the order that the states appear in this xml file)

<suspend>: probabilities vector of the suspended source state

The matrix and the vector have a field which is the continuation of the numerical values of the coefficients, separated by a space or line feed.

The expr subtag defines in its field an arithmetical expression which is based on:

numerical values states (#id)

current value of a system (#id)

preceding value of a system (@id)

+, *, −, /, % , &, |, &&, || ,^, !, ~ if . . . then . . . else . . .

rand (returns a real number between 0 and 1)

sin, cos, tan, etc.

The constraint tag describes a mixing calculation constraint that is possibly interactive.

Its attributes are, in addition to "name" and "id":

State: id of the state to be forced

Level: importance of the constraint

Interactive=yes|no

Default: yes|no

Startup: yes|no

Icon: graphics file

The framework tag describes the structure model of the file. It is useful for the editing phases, by automatically producing some structure elements (primarily relations).

For example, for the "song" framework:

an abstract component serves as harmony an abstract component serves as style an absolutely constrained abstract component serves as score a track contains the original a track containing the voice an abstract component chosen, via alpha relations, between the original and the mix a constraint per style a constraint to switch to original mode a constraint to suppress the voice etc.

A gamma relation is applied between the score component and each of the audio tracks.

A gamma relation is applied between the style component and each of the audio tracks.

A gamma relation is applied between the harmony component and each of the audio tracks.

A tau relation is applied to the harmony in order to switch linearly from one to the other, and which skips the first harmony when replayed.

A tau relation is applied to the original track in order to loop the elements of the original track.

A tau relation is applied between the harmony track and the original track.

A tau relation is applied between the original track and the harmony.

A piece is defined as:

the xml description file the wav, icon, etc. files

A composite format is defined making it possible to group all of these elements together in a single file.

The complete file initially contains a table of subfiles:

number of files, name of the file, size, index, in the composite file.

The description file is named "index .xml".

Files referenced by the xml are first searched for in the subfile table, then on the local disc.

The function of the expert system is to:

instantiate a performance, propose interactivity on the performance, handle switching from one performance to another.

Figure 2:
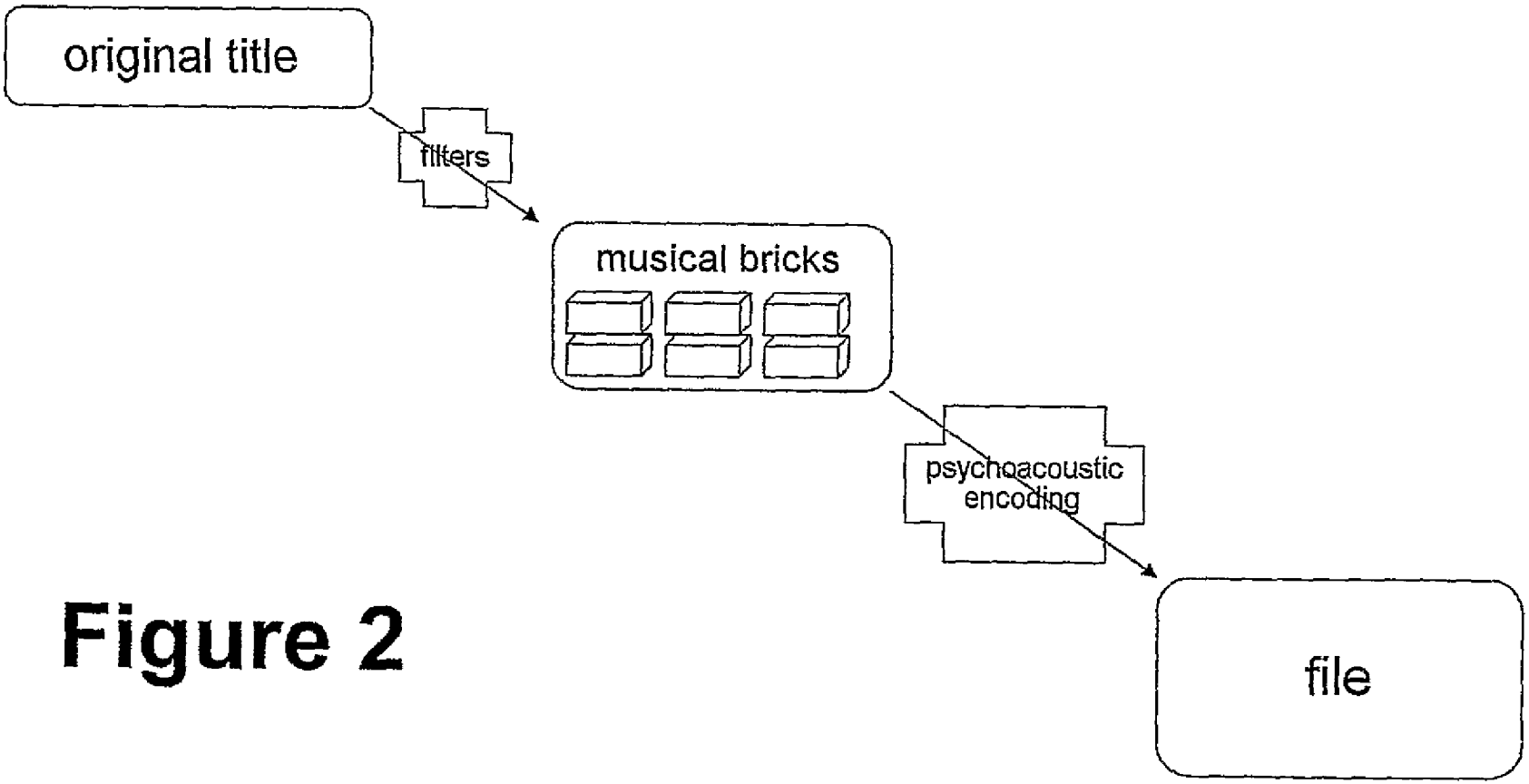
FIG. 2 is an arrow diagram showing the principle of an encoding process of a pre-existing music, in accordance with the method according to the invention.
Figure 3:
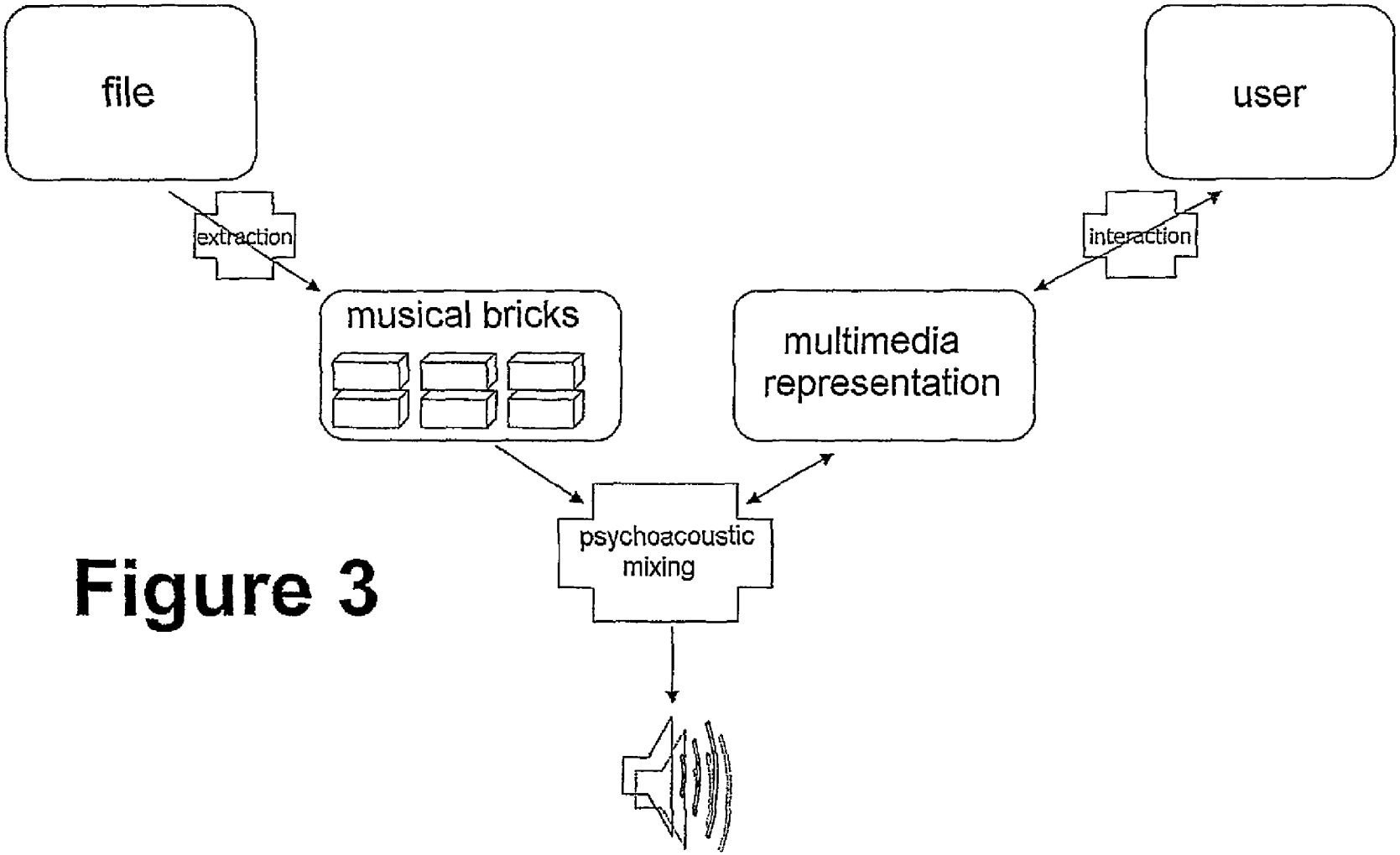
FIG. 3 is an arrow diagram showing the general operation of the execution programme ("player") implemented by the method according to the invention.

In the example shown in FIGS. 2 and 3, the point of departure of the production of a musical content according to the invention consists of an audio or video file, in digital format. This initial sequence has a tempo which will be used in the breaking down into sequences and to give the indication of clocking to the execution programme.

The first step in the method consists here in a segmenting into sequences of duration corresponding to a multiple of measures (in the musical sense). This segmenting can be carried out manually, for example using traditional music editor software or via a pedal controlled by rhythm controlling the recording of end-of-measure markers. Segmenting can also be carried out automatically, by analysing the sequence. The result of this first step of segmenting is the production of initial audio materials or initial video materials, comprised of digital files.

The second step consists in applying filters to these initial audio or video materials, in order to calculate, for each initial material, one or more filtered materials, in a format corresponding to the execution programme used (for example an MP3 format—registered trademark). Each filtered material is associated to an identifier, for example the name of the file. A set of specific filtered material is thereby constructed, i.e. resulting from the filtering of the initial sequence. These filters can be comprised of:

a filter isolating the voice of a singer, or orchestration, a distortion filter, a filter for adding sounds, a filter producing special effects, etc.

Optionally, a "leader" (song track) is maintained on which is organised the other filtered materials in order to maintain the original structure.

Moreover, "universal" filtered materials are added for which the length may exceed that of a "specific filtered material". These are musical or video digital files, which do not depend on the initial video or musical sequence.

In order to allow the listener to interact with the produced file, three series of components are prepared:

psychoacoustic criteria tracks a collection of filtered materials or "bricks" which comprise the above-mentioned subcomponents.

Psychoacoustic criteria are defined, for example:

the volume, the order number in the initial sequence the level of resemblance to the initial sequence the quality of the starting brick or end of piece, solo element (turning off the other tracks), element played systematically with another brick, etc.

Then, a set of tracks is constructed (n video tracks, m audio tracks, z text tracks, lighting, or a filter e.g.: volume applied to tracks x and y (some tracks defining effects applied to other tracks, inter-track relations), etc.). There are also tracks referred to as "control", which have no substantial effect for the eye or ear, but which determine the parameters on which the other tracks will use as a base. For example a track will determine the harmony to be respected by the other tracks.

Then a collection of subcomponents or bricks is constructed: each brick is comprised of a filtered material, to which is associated:

coefficients corresponding to its weight in relation to each of the psychoacoustic criteria (manually or automatically)

a track chosen from amongst the collection of tracks.

Interaction cursors are then defined, allowing the user to interact with the musical execution.

The next step consists in defining for each track, an evaluation function which consists in weighing each brick according to constants (psychoacoustic criteria) and a context (cursor values, and history of the piece currently being executed).

Optionally, for each track, internal variable modification functions are defined, for each brick (edge effect), called at the beginning and at the end of each brick.

The various functions allow for basic arithmetical calculations, recourse to a random number generator, the use of complex structures and the management of edge effects. Distance function: avoids evaluating the totality of the brick combinations, and to apply the function only to bricks that are "close" to the brick for which playing has just completed. An audio/video sequence is thereby constructed of which the format corresponds to a multimedia format dedicated to the interactive music.

The format makes use of the notion of "piece". Remember that a piece is a multimedia sequence of any duration, possibly unlimited.

The format according to the invention is based on multimedia subcomponents or bricks, which are mainly audio bricks, but which for some are also video, textual or others. Certain bricks can also be multimedia filters (audio, video, etc. filter) which will be applied to other bricks.

The system produces a multimedia sequence by assembling and by mixing bricks as described in what precedes.

The choice of the bricks to assemble and mix can be accomplished in function of the interactions of a user while the sequence is being executed.

The system is comprised of several stages:

composition files execution programme.

The composition of a piece is carried out by assembling, in a non-exhaustive manner:

multimedia elements called "bricks": music extracts, video extracts, 3D animations, texts, audio and video filters, etc. Each brick is a timed sequence of limited duration, coding various multimedia events parameters referred to as "psychoacoustic", determining the constant attributes of the bricks interaction cursors evaluation functions, determining the way in which the selection of the bricks is going to take place.

This assembly normally gives rise to a file containing or referencing the above-mentioned items.

The encoding format of the contents of each brick is not hard-coded in the specification. It can make use of a standard format, MP3 for example (registered trademark).

The format contains the lists of the parameters corresponding to the psychoacoustic criteria as well as the description of the interaction cursors.

Furthermore, the format includes the various evaluation functions. These functions are described in the form of a bytecode of which the characteristics are part of the specification. This bytecode has a purpose to be interpreted by a virtual machine incorporated in the execution programmes.

The file is open to the addition of metadata making it possible to enrich the pieces and in particular to enrich their rendering by the execution programmes.

The execution programme is software capable of reading files generated by the method according to the invention, then of executing the corresponding pieces.

The execution programme is capable of interpreting the bricks contained or referenced in the file.

The execution programme is capable of managing the interaction cursors, possibly automatically, without having recourse to a user, but by offering the user in general an interaction interface.

Finally, the execution programme is capable of evaluating the evaluation functions and of selecting the bricks to be mixed according to the result.

A piece is defined in the following manner:

a tempo: $\Pi$ a set of tracks: T a non-symmetric and not necessarily injective $\beta$ relation indicating that a tracks acts on another track: $t \beta t'$ a set of psychoacoustic criteria: C a set of multimedia bricks, each one associated to a track: $B=b_{t,j}$, $t \in T$); by extension, $B_t$ shall denote the bricks associated to a certain track a set of values, evaluating each brick on each psychoacoustic criteria: $K=\{k_{c,b}, c \in C, b \in B\}$ a distance function, possibly Euclidian, on psychoacoustic criteria:

$d_t: B \times B \rightarrow \mathfrak{R}^+$ a psychoacoustic limiter, possibly infinite: $\lambda_t \in \mathfrak{R}^+$ a set of interaction cursors: I a set of interaction parameters, giving the current value of each interaction cursor: $P=\{p_i, i \in I\}$ the list of bricks currently being broadcast on each track, and the number of repetitions: $H=\{h_t, t \in T, h_t \in B\} \cup \{r_t, t \in T\}$ a set of general parameters (for example, elapsed time since the beginning of the piece): G a set of global variables for general use: V evaluation functions associated to each track:

$F=\{f_t, t \in T\}$, with $f: B_t \times K \times P \times H \times G \times V \rightarrow \mathfrak{R}$ these functions may be based on a rand random generator: $\emptyset \rightarrow \mathfrak{R}\ [0, 1[$ these functions can generate edge effects on the set V in order to optimise the management of these edge effects, functions for the brick start and end, for each track:

$S=\{s_t, t \in T\}$, with $s_t: B_t \times K \times P \times H \times G \times V \rightarrow \mathfrak{R}$ $E=\{e_t, t \in T\}$, with $e_t: B_t \times K \times P \times H \times G \times V \rightarrow \mathfrak{R}$ During the execution of a piece, the execution programme mixes all of the tracks permanently. On each track, it chains the bricks together, one at a time.

At the end of each brick, the execution programme selects the next brick that it will start at the next tempo.

Selecting the next brick to play on track t is performed by determining the brick b that maximises $f_t$ (b, K, P, H, G, V). This calculation is performed on bricks $b \in B_t$, such that $d_t(b, b_0) < \lambda$, where $b_0$ is the brick that has just completed.

According to the number of bricks contained in the piece and the computing power of the execution programme, the value $\lambda$ could be reduced dynamically.

At the start of a brick, the execution programme evaluates the function $s_t$ (b, K, P, H, G, V); at the end of the brick, it evaluates the function $e_t$ (b, K, P, H, G, V). The function $s_t$ can where applicable, by means of the edge effects, alter the playing parameters of the brick (repetition, pitch, general volume, etc.).

The user interacts on interaction parameters P.

The mixing operation depends on the type of bricks. Generally, tracks are not independent, the $\beta$ relation defines the dependencies. For example a track chaining together sound effects (volume, echo, etc.) will be applied to the mixing on an audio track.

Examples: Pure random operation

The execution programme randomly chooses at any time a brick from among all of those available.

$d(b, b_0)=0$ $f_t$ (b, K, P, H, G, V)=rand

The execution programme randomly chooses at any time a brick from among all of those available and performs a repetition of the brick a variable number of times, equal to $1, 2, \ldots, 2^n$, where n is a repetition parameter of the brick.

$C = \{ \text{repetition} \}$
$d(b, b_0) = 0$
$f_t(b, K, P, H, G, V) =$
if $b \mathrel{!=} h_t$ then rand
else if $r_t < 2^{k_{repetition,b}}$ && $r_t \mathrel{!=} 2^{E(rand \times k_{repetition,b})}$ then $-1$
else 1

The bricks are ordered and the execution programme systematically chooses the following brick, and loops back to the first one at the end of the sequence.

$C = \{ \text{order} \}$
$d(b, b_0) = 0$
$f_t(b, K, P, H, G, V) =$
if $h_t = \emptyset \,||\, k_{order,b} <= k_{order,ht}$ then $-k_{order,b}$
else $k_{order,ht} - k_{order,b}$ The file groups the following elements together is a structured way:

- general parameters (primarily the tempo)
- the number and description of the tracks, in particular the type of each one (audio source/sound effect/subtitle/video/visual filter)
- relations between the tracks: for example, track 3 manages the crescendo of track 2
- the number and description of the psychoacoustic characters
- the various multimedia materials (either directly incorporated into the file, or referenced by a path on the disc or a url)
- the list and description of each brick (a brick contains multimedia material, but the same material can be used by several bricks)
- the table of psychoacoustic character values of each brick
- the number and description of the interaction cursors
- the list of distance function of each track, defined in the form of a bytecode, as well as the associated limiter
- the list of evaluation functions of each track, defined in the form of a bytecode
- the list of starting and ending functions of each track, defined in the form of a bytecode.

The format of the multimedia materials is free: mp3, wav, etc. The associated codec must obviously be present in the execution programme.

The bytecode is a stack bytecode, allowing for basic arithmetical calculations, recourse to a random generator, the use of complex structures (lists, tuples, vectors) and the manipulation of functions.

With regards to user interfaces, it should be noted that the manner in which the user interacts on the algorithm for choosing bricks has a certain variety.

In a simplified alternative, the user could, for example, have a graphics interface comprised of a certain number of buttons or cursors for interaction of which the number and type depend on the work under consideration.

The authors of content using the method according to the invention will be able to integrate some of these buttons or cursors into all of their works (or multimedia sequences), in such a way as to make certain types of interaction uniform, such as: calmer/neutral/more dynamic.

The interaction cursors could also be driven by biometric data:

- course clocking (pedometer)
- heart rhythm
- EEG (electroencephalogram) waves, or "brain waves"

In this latter example, it is in particular known that it is possible to measure the state of stress or the state of concentration of the user. Two modes of interaction are thereby possible:

- In an active mode, the user will be invited to drive the music by modifying his or her mental state; this requires particular effort on the part of the user since he or she must learn how to control his or her brain activity, which requires major effort to learn: in fact, this mode has an educational use only.
- In a passive mode, the user could ask, for example, the system to maintain him or her in a state of relaxation or in a state of concentration. The system then will automatically drive the "calmer/neutral/more dynamic" buttons via a simple kickdown: to maintain the user in a state of calm, the "calmer" button will be activated when the EEG waves indicate the beginning of excitation concerning the user, and the "neutral" button will be activated when the user is at a low level of stress.

The invention claimed is:

1. Method for the automatic or semi-automatic composition, of a multimedia sequence including a prior phase including the creation of a reference structure of a multimedia sequence and the breakdown of said structure into a limited numbers of basic components assimilated to tracks, each of these basic components associated with a set of basic subcomponents (or bricks) which comprises at least musical movements, harmonies or styles and an automatic composition phase of a new multimedia sequence containing a choice of subcomponents, wherein said prior phase comprises the assigning of psychoacoustic descriptors or attributes to each of the subcomponents and the storage of subcomponents and descriptors or attributes that are assigned to them in databases and said automatic composition phase comprises a generation on the basic components of a sequence of subcomponents with a chaining characterised by a maintaining or a replacing of the subcomponents said chaining being calculated according to an algorithm that determines, for each subcomponent a selection criterion taking into account its psychoacoustic descriptors or attributes and context parameters, said composition phase repeating through looping, each sequence of subcomponents regenerating itself permanently at a hearing rhythm by associating a subcomponent to each basic component, the listener being able to intervene during said composition phase on the choice of subsequent subcomponents by influencing the operation of above-mentioned algorithm.

2. The method in claim 1, wherein the choice of subsequent subcomponents that is carried out during the automatic composition phase is carried out randomly, respecting a selection criterion defined by an algorithm which determines, for each subcomponent, the probability of being chosen, taking its attributes and context into account.

3. The method as claimed in claims 1, wherein said probabilities are calculated by applying rules that are independent of the substance of the subcomponent.

4. The method in claim 3, wherein said rules consider that the choice of a subcomponent influence the other concomitant choices or those to come, and wherein a rule consists in modifying the probability of choosing a variation according to prior or concomitant choices.

5. The method in claim 1, wherein the choices made, during said composition phase, are not random and entail the subcomponent benefitting from a maximum selection criteria.

6. The method in claim 3, wherein said rules are characterised by a degree of importance or priority.

7. The method in claim 6, wherein when two rules are contradictory, the one of less importance is momentarily deleted in such a way that a choice of subcomponent is always possible.

8. The method as claimed in claim 1, wherein said composition phase is implemented by a global system manipulating a virtual mixing console containing a number of tracks that is potentially infinite, tracks that can be activated and deactivated unitarily, tracks of a varied nature, a number of control organs (buttons, cursors) that is potentially infinite, the activation of a track chaining together subcomponents that are compatible with the type of track, the system determining a minimum duration during which a chosen subcomponent is maintained.

9. The method in claim 8, wherein said global system comprises:

an abstract engine working on constraints imposed by a base of rules and computing values of a list of systems of the space of missing calculation, a model of virtual mixing console allowing an interaction interface to be generated using selected elements.

10. The method in claim 9, wherein each track of the virtual mixing console is associated to one or more variables.

11. The method in claim 10, wherein for an audio track, a system indicates the subcomponent to be played, while an arithmetical system indicates the number of repetitions to be performed, an arithmetical system indicates the importance of the repetition constraint and an arithmetical system indicates the volume.

12. The method in claim 10, wherein each track is associated to a main system which selects the subcomponents of this track and secondary systems which define the attributes of the track, and wherein, when the value of the main system changes, the system determines a minimum desired duration by using the attributes.

13. The method in claim 10 in which tracks must be synchronised, wherein when a subcomponent is selected on one of said tracks, playing of it begins at the exact moment that led to its selection, this moment being determined by one of the systems that then plays the role of master system.

14. The method in claim 13, wherein said playing is not carried out in a loop, even if the subcomponent is to be repeated in such a way that, during a next step:

either the subcomponent is still being played and the system simply continues to play it, or the playing of the subcomponent is finished and, if the subcomponent remains selected, playing is started again in a new step at the exact moment of this new step.

15. The method in claim 8, wherein said system comprises a file designed to bring together in a structured manner the following elements:

definition of the mixing calculation definition of the multimedia elements definition of the mixing console definition of the tracks, and the link between the tracks link between the tracks and their attributes and the mixing calculation systems link between the multimedia elements and the states of the mixing calculation definition of the constraints proposed for interactivity and of the conduct to hold when interactivity is not offered by the expert system.

16. The method in claim 5, comprising the following steps:

the creation using a predefined musical sequence of tracks comprised of successions of musical subcomponents by application of a filter or processing on said musical sequence, the creation of a base of musical subcomponents including the subcomponents thereby created as well as pre-existing subcomponents selected according to their coherence with the created subcomponents, the definition of a nomenclature of psychoacoustic descriptors, the construction of a table defining a score for each pair including a subcomponent and a descriptor, the definition of a subset of descriptors on which a user can interact through the intermediary of a mixing interface, via a specific interaction weight, the construction of a list of mixing functions, each function being linked to a track, each function being applied to a candidate subcomponent with the context parameters comprising at least a subcomponent that has just been played, subcomponent currently being played on the other tracks, interaction weight defined by the user and having for result a pertinancy ratio of the candidate subcomponent, the selection of the candidate subcomponent for which the result of the mixing function is maximal.

17. The method as claimed in claim 1 wherein at least one part of the subcomponents are control subcomponents including information for driving a peripheral device.

18. The method as claimed in claim 1, comprising an automatic subcomponent selection step according to the information provided by the physical sensors or remote computer sources.

19. The method as claimed in claim 1, furthermore containing non-musical subcomponents.

20. The method in claim 16, wherein carrying out at the start of a subcomponent, an execution programme of a function $s_t$ modifying the context parameters, and carries out at the end of the subcomponent, an execution programme evaluating the function $e_t$ applied to context parameters.

21. A device for the implementation of the method as claimed in claim 1, the device comprising:

means for creating a reference multimedia sequence structure and for breaking down the reference multimedia structure into a plurality of tracks, each track containing a set of subcomponents, means for assigning descriptors or attributes, and means for automatic composition to these subcomponents in real time, with the possibility of assistance, of a new multimedia sequence containing, for all or for a part of the basic subcomponents of the reference sequence, the maintaining or replacing of said subcomponents by respective homologous subcomponents, means of algorithmically choosing said components using an algorithm that determined for each basic subcomponent or homologous subcomponent the probability that each basic subcomponent is chosen, taking attributes of each basic subcomponent into account, then by carrying out said choice in respect of said probabilities and means to repeat said automatic composition phase by relooping by regenerating each sequence and by associating a subcomponent to each basic component, and means for allowing the listener to intervene on the choice of subcomponents by influencing the operation of said algorithm.

22. The device according to claim 20, further comprising a graphic interface comprising interaction buttons or cursors which number and type depend on the work under consideration.

23. The device according to claim 22, wherein certain of said buttons or cursors are integrated in multimedia sequences, in such a way as to make certain types of interactions uniform, such as: calmer/neutral/more dynamic.

24. The device according to claim 22, wherein the interaction cursors or buttons are driven by biometric data such as a course clocking, a heart rhythm or EEG (electroencephalogram) waves.

25. The device according to claim 22, wherein the device is capable of being operated in two modes:

an active mode in which the user is invited to drive the music by modifying his mental state;

a passive mode in which the system automatically drive the buttons and the cursors via a simple kickdown.

* * * * *